US007980412B2

(12) United States Patent
Belleggia

(10) Patent No.: US 7,980,412 B2
(45) Date of Patent: Jul. 19, 2011

(54) PIZZA CONTAINER

(75) Inventor: Giulia Belleggia, Guidonia (IT)

(73) Assignee: Gruppo Pluripack s.r.l., Fonte Nuova (RM) (IT)

( * ) Notice: Subject to any disclaimer, the term of this patent is extended or adjusted under 35 U.S.C. 154(b) by 640 days.

(21) Appl. No.: 11/632,534

(22) PCT Filed: Jul. 12, 2005

(86) PCT No.: PCT/IT2005/000396

§ 371 (c)(1), (2), (4) Date: Jan. 17, 2007

(87) PCT Pub. No.: WO2006/008772

PCT Pub. Date: Jan. 26, 2006

(65) Prior Publication Data

US 2007/0241110 A1 Oct. 18, 2007

(30) Foreign Application Priority Data

Jul. 19, 2004 (IT) ..... RM2004A0364

(51) Int. Cl.

| | |
|---|---|
| ***B65D 21/00*** | (2006.01) |
| ***B65D 6/28*** | (2006.01) |
| ***B65D 8/04*** | (2006.01) |
| ***B65D 8/18*** | (2006.01) |
| ***B65D 45/00*** | (2006.01) |
| ***B65D 85/62*** | (2006.01) |

(52) U.S. Cl. ..... 220/608; 220/4.21; 220/4.27; 220/315; 206/508

(58) Field of Classification Search ..... 220/4.21, 220/4.27, 315, 608; 206/508
See application file for complete search history.

(56) References Cited

U.S. PATENT DOCUMENTS

| | | | | |
|---|---|---|---|---|
| 4,058,214 | A * | 11/1977 | Mancuso | 206/545 |
| 5,456,379 | A * | 10/1995 | Krupa et al. | 220/835 |
| 5,662,237 | A | 9/1997 | Cain et al. | |
| 6,095,324 | A | 8/2000 | Mullin et al. | |
| 6,257,401 | B1 * | 7/2001 | Mangla et al. | 206/204 |
| 6,257,434 | B1 | 7/2001 | Lizzio | |
| 6,595,366 | B1 * | 7/2003 | Brown | 206/551 |
| 6,601,758 | B2 * | 8/2003 | Lizzio | 229/120 |
| 6,860,194 | B2 * | 3/2005 | Pope | 99/401 |

* cited by examiner

*Primary Examiner* — Anthony Stashick
*Assistant Examiner* — Madison L Wright
(74) *Attorney, Agent, or Firm* — Young & Thompson

(57) ABSTRACT

A container or package for pizzas, made of thermoplastic material, including a cover (1) and a dish or plate (2), wherein the cover (1) has a plurality of first holes (8) arranged centrally and a plurality of second holes (6) arranged along its circumference or circular edge (or in the neighborhood of the latter). Several radial channels (11) interconnect these two pluralities of holes (6 and 8). Preferably, the container (1, 2) is transparent; thereby allowing to recognize the kind of food it contains.

19 Claims, 3 Drawing Sheets

PIZZA CONTAINER

TECHNICAL FIELD

The present invention relates to a pizza container, or packaging, and more generally to a container for warm food, which is realised is such a way as to preserve the heat and fragrance of a pizza during its transportation from the selling place to the place where it is eaten. The packaging according to the invention has features distinguishing it from those of the background art, in particular with regard to the manner in which the vapour (steam) inside the packaging is handled, that is, insuring a greater fragrance of the food product at the time when it is eaten.

BACKGROUND ART

There already exist various patent documents of the background art, concerning containers for pizzas and generally for warm food.

Cardboard-made containers are widespread but their drawback is that they do not insure a perfect sealing; this drawback is very serious if a warm food (for instance a pizza) comprises liquids that may drip during its transportation from the place where it is sold to that where it is eaten.

Therefore, a great number of pizza sellers prefer—for their clients—to use plastic-made containers that usually include two circular parts, wherein one of them forms the dish (plate) and the other the cover.

The cover and dish are coupled to each other by a joint at their circumference, along the edge of their raised side walls. Provided the packaging is always held in a substantially horizontal position, no leakage of liquids will occur since the plastic-made dish does not present any hole or discontinuity.

Plastic-made containers of the background art have many features which differentiate them from each other, but they also have features in common. Some embodiments exist with a dish or tray made of plastics arranged within a cardboard-made container (see e.g. U.S. Pat. No. 6,601,758).

It has now become usual to provide, on the cover, a plurality of vent holes for the vapour (steam) developed by the warm food, in order to preserve food fragrance. Said vent holes for the vapour (which in this way can escape to the outside) serve to prevent condensate formation inside the plastic packaging and are described—for instance—in the European Patent Application EP 1 112 946 A1.

However, in this latter patent application and in the other documents belonging to the background art, that are known to the inventor of the present patent application, the aforementioned vent holes or apertures are arranged along the outside or peripheral edge (peripheral circumference) of the pizza container or warm food container. Actually, EP 1 112 946 A1 highlights the importance of a solution according to which the plastic-made container has a noticeable thickness of its cover and dish, and a density gradient of the plastic material, thereby insuring a greater resistance to impacts on its external side, and having a foam material inside in order to obtain an improved thermal insulation.

However, since the vent apertures for the vapour (steam) are arranged along the outer edge of the cover, when the pizza is put inside the container these apertures will be located near the crust of the pizza and not near the central part of the pizza where—actually—the most part of the vapour is formed. It follows that the background art does not generally disclose an efficient system to let the vapour (steam) escape to the outside, which system is in fact indispensable to avoid condensate formation inside the plastic-made container and therefore to maintain the fragrance of the pizza up to the moment when it is eaten.

An object of the present invention is to provide a container for a pizza and for other kinds of warm food, which is designed to promote the escape of condensate to the outside of the plastic-made container in a much more efficient manner than traditional containers.

A further object of the present invention is to let the type of food (or the type of pizza) contained inside the packaging be visible (be recognisable) from outside. Still another object of the invention is to provide a product having a convenient cost and allowing a perfect sealing on the dish side (lower part of the packaging), and moreover, which is capable of resisting to heat.

Other specific advantages of the present invention with respect to the background art will be emphasised in the following detailed, non-binding description of a preferred embodiment.

DISCLOSURE OF INVENTION

The present invention provides a container, or package for a pizza and generally for warm food, comprising a cover and a dish (plate) that are connectable to each other by a joint, in order to close the container, using alignment and engagement means, the said container being characterised in that it is provided, in a central portion of its cover, with a plurality of first vent holes for allowing the steam to escape, which steam is developed by the warm food contained in the container.

Preferably, a plurality of second discharge holes for allowing the escape of vapour (steam) into the atmosphere, are provided—in the same way as in the background art—along the circumference (or more generally along the edge) of the container. Moreover, preferably, said first and second holes are advantageously obtained in recesses of the cover, that is, in depressions on the surface of cover, and are also interconnected by means of substantially radial channels which are also formed on the surface of the cover during the moulding process of the thermoplastic material which forms the container. In this manner, when several containers, containing a respective pizza, are stacked on top of each other, for instance for transport purposes, the vapour (steam) developed inside the lower containers of the pile can freely escape from the first vent holes and diffuse into the radial channels, thereby preserving the pizzas in their warm state, and preventing at the same time the formation of condensate inside the containers. Moreover, since—in this preferred embodiment—the second holes (those arranged along the edge) are also located in recesses, the vapour (steam) can directly escape in the atmosphere also from the lower containers of the pile.

Preferably, the thermoplastic material used to produce the containers will be light-transparent polystyrene of the quality employed for foodstuffs. The light-transparency of the material is important because the kind of alimentary product (e.g. the type of pizza) contained in the package can be immediately recognised. This is also essential for the seller, since it reduces the probability of mistakes being made in the distribution of the pizzas to the customers.

Furthermore, it may occur that a container has to be briefly reopened to check what kind of pizza it contains, and this gives rise to a heat dispersion that should be avoided until the moment the pizza is eaten.

Other specific features of the container, in addition to the previous ones, and which further improve its quality, are defined in the remaining dependent claims.

BRIEF DESCRIPTION OF DRAWINGS

The present invention will now be described only for illustrative but non-limitative and non-binding purposes, by referring to a specific embodiment thereof, which is shown in the annexed drawings, wherein.

DISCLOSURE OF THE BEST MODE OF CARRYING OUT THE INVENTION

Figure 1:
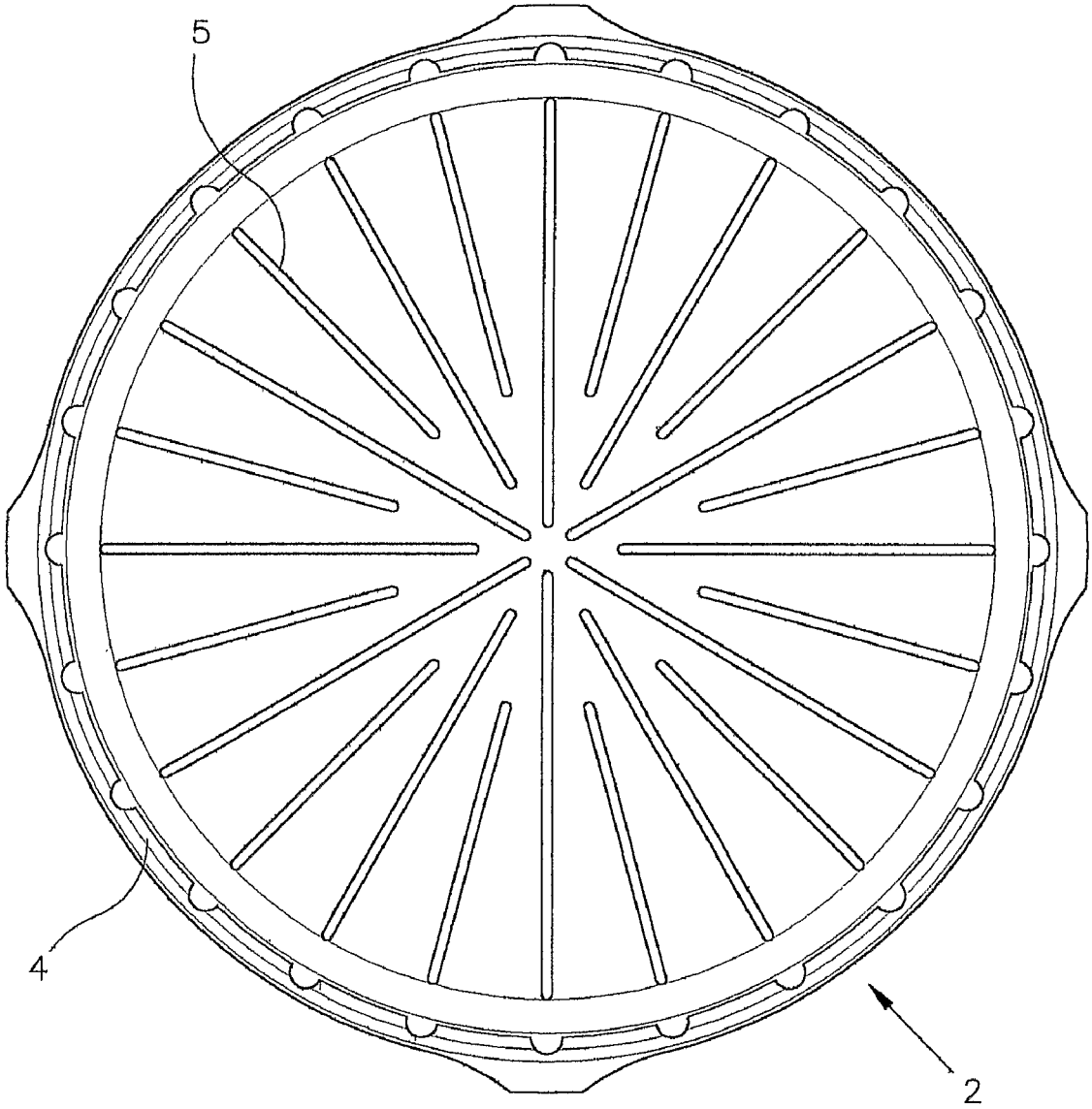
FIG. 1 is a plan view of the inner side of the dish of the container according to the present invention.

The improved pizza container or packaging according to the present invention is made of plastic material, preferably of polystyrene of the type used for foodstuffs. It includes an upper part 1, or cover, and a lower part, or dish, 2. The two parts 1 and 2 have a circular shape and may be manufactured by injection moulding, blowing, or any other kind of suitable process. They have means 3, 4 for their mutual engagement and alignment, which are provided on their outside (peripheral) edge, and possibly also a tongue to facilitate the opening of the packaging or container.

The lower part of the container, that is, the dish 2, has substantially radial ribs 5 for the purpose of preventing or reducing heat loss from the pizza or the like, and also for preventing the pizza from sticking to the dish. This latter function is obvious not only to a skilled person but also to a layman, and this explains why these means are largely employed in conventional pizza containers.

The regions of the dish 2 located between the ribs 5 may be smooth or knurled. These ribs give rise to projections on the inner side of the dish 2 (visible side in FIG. 1) and to cavities or recesses on the outer side (not shown), similar to the drawing of sheet metal. Thus, they also obviously have the function of reinforcement means. Turning the attention in particular to FIG. 2, which shows the outer side of the cover 1 of the container according to the preferred embodiment of the invention, one notices several holes 6 (of triangular shape in this figure) formed around the circular periphery of the cover; these holes 6 are provided, as in the background art, for the escape of the vapour developed by the pizza or any other warm food. In contrast with the background art, each hole 6 is formed on a respective recess 7 of the cover 1; in this manner, when stacking several containers of the same kind each hole 6 is not directly adjacent the surface of the lower side of the overlying dish 2 included in the pile of containers. Thus, the various holes 6 will remain "open", that is unobstructed, even if several identical containers are stacked on top of each other for their transportation.

As has been repeatedly said, the disadvantage of providing holes 6 disposed only along the circumference of the cover 1, lies in the fact that the condensate, which is normally mostly formed near the central portion of the pizza, cannot immediately escape to the outside of the container and is therefore forced to move along a longer path before reaching the vent holes 6. Those skilled in the art know that this has a negative influence on the fragrance of the pizza, which becomes softer and less palatable.

Figure 2:
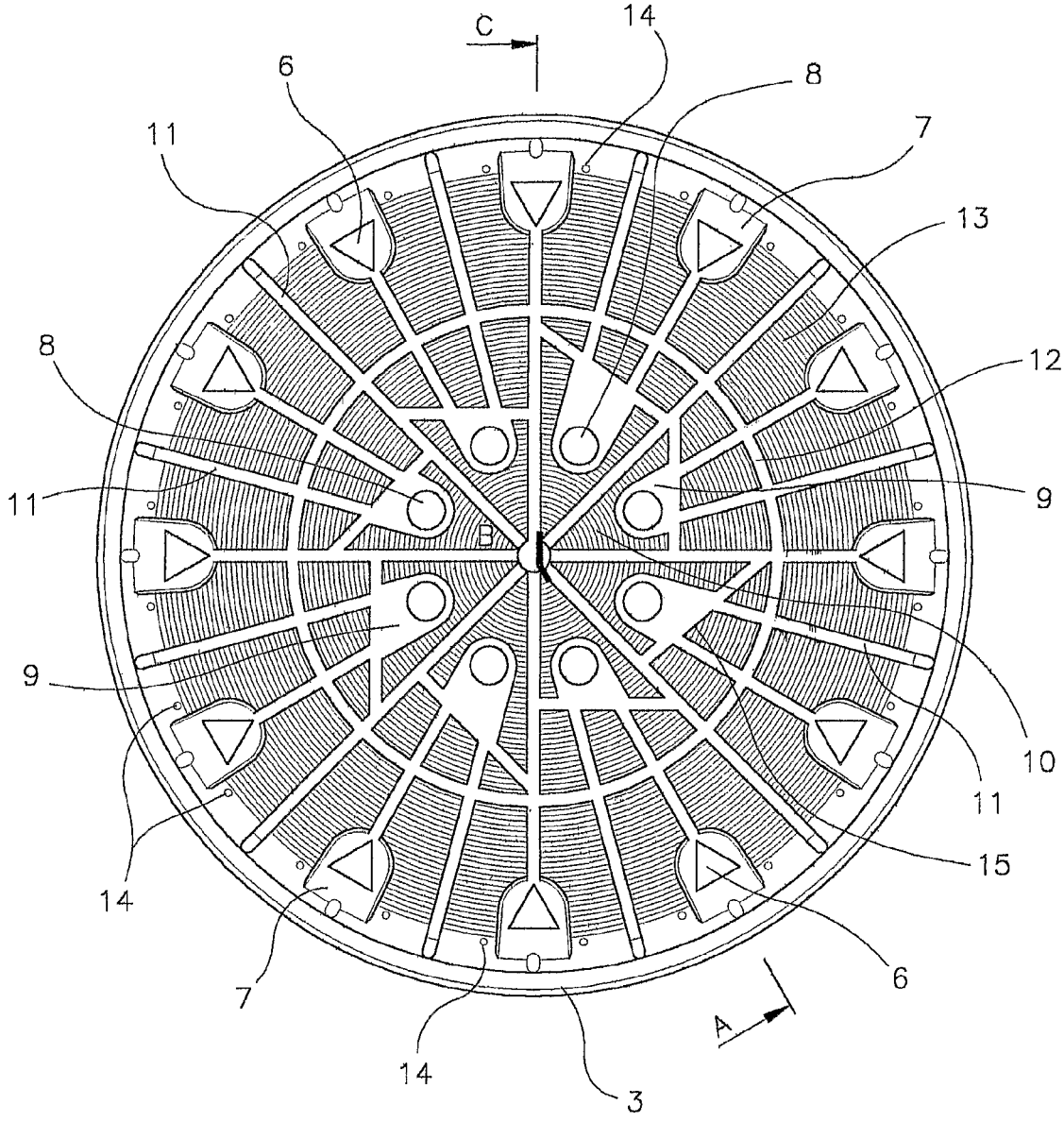
FIG. 2 is a plan view of the external side of the cover making part of the container according to the present invention.
Figure 3:
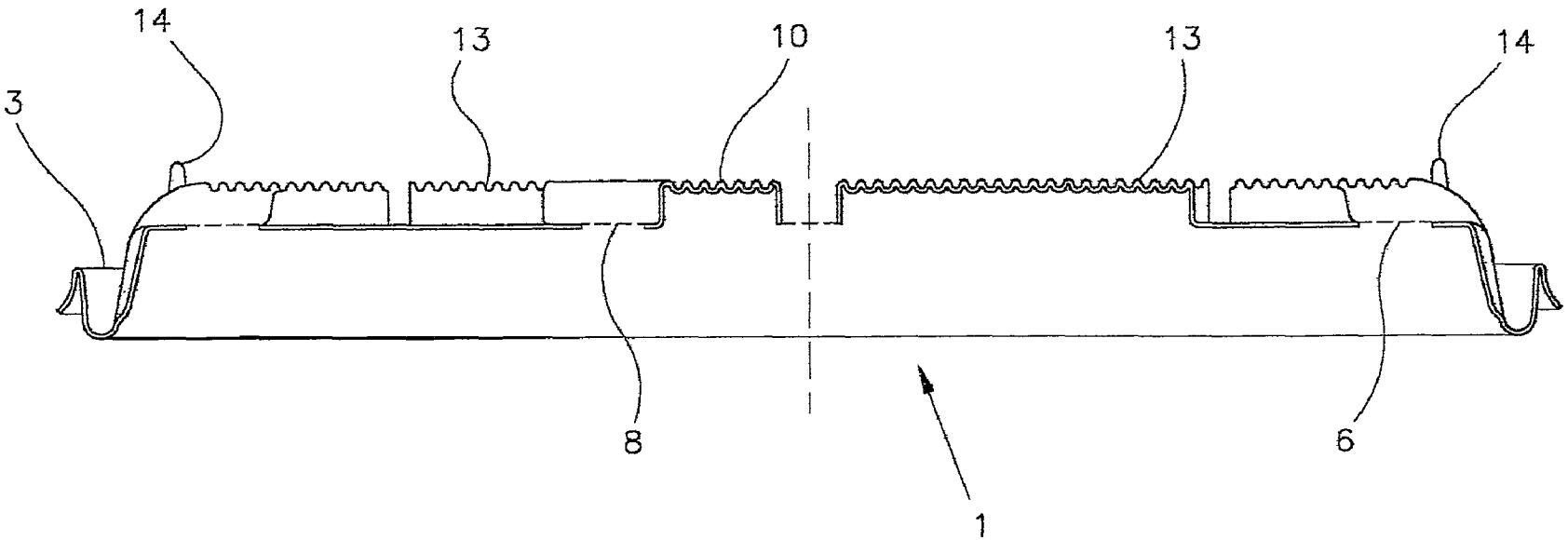
FIG. 3 is the cross-section of the cover taken along the line marked A-B-C in FIG. 2.

In order to overcome this drawback, according to the present invention a plurality of holes or windows 8 have been provided on the central portion of the cover 1 of the plastic-made container, where respective recesses 9 are formed whose level (height) is more or less equal to the height of the recesses 7 associated with the triangular holes 6 (see also FIG. 3 showing a cross-section along line A-B-C in FIG. 2).

Therefore, the vapour (steam) which is generated predominantly in the central part of the container, where the hottest and the most humid part of the pizza lies, can be directly discharged into the atmosphere from said holes 8, besides, obviously, from the peripheral holes 6, even though to a limited extent; on the other hand, in case of stacked containers, the vapour (steam) will be subdivided into fractions moving along a plurality of radial channels 11, each of which connects two respective recesses 7 and 9. The bottom of these channels 11 will lie substantially at the same level as the recesses 7 and 9.

It should be noted that approximately half the way between the center of the cover 1 and its outer circumference, there is a further channel 12, of circular shape, which contributes to let the vapour move more freely on the outer side of the cover 1. Thus, if several containers, of the same kind as the described one, are stacked on top of each other, said hot steam circulating inside the channels 11, 12 and inside the recesses 7 and 9 will help in maintaining warm the pizzas contained in the various piled containers, without adversely influencing the fragrance of the pizzas that are contained in these containers.

If the containers are not stacked on top of each other the vapour (steam) directly escapes into the atmosphere through the holes 7 and 8, especially through holes 8. Normally, the plastic containers of the background art are totally realised with an opaque material, for instance a material having a white colour.

On the contrary, according to the present invention the container is preferably made of light-transparent polystyrene for foodstuffs. This peculiarity, to be considered preferable but not binding, allows the user to immediately recognise the kind of food (for instance the type of pizza) from outside the container, and it may be useful also for the owner of a restaurant in order to avoid mistakes during the distribution of the pizzas to the various customers, that is, to those eating the pizzas inside the restaurant and those that only come to buy it and carry it away.

The cover 1 of the container also has an inner surface which is not smooth but knurled, denoted by numeral 13, in the regions between the triangles 10, the radial channels 11, the circular channel 12, and the recesses 7 and 9. These knurled regions 13, which, as already explained, extend on all the inner face (inner side) of the cover 1, are used to prevent the formation of condensate beads (condensate drops) on the inner side of the container cover 1; these beads, when falling, would hydrate (moisturise) and soften the transported food. The external sides 15 of the triangles 10 delimit a central reinforcement area.

Reference numerals 14 denote small cylindrical projections in the form of pins located on the outer (upper) side of the cover 1, which are used to prevent an accidental mutual slippage of the stacked containers; in fact, the tiny pins 14 of an underlying container "naturally engage" the cavities formed externally by the ribs 5 of an overlying container (on the lower or external side of the dish 2 of the latter). Note that the container according to the present invention may form two separate parts 1 and 2, or a single piece of plastic material connected by a tongue-like hinge. In any case all features of the cover 1 and dish 2 may be obtained by a single moulding process, blowing process, etc. of thermoplastic material. This material may have variable percentages of crystal and anti-impact additives. It is important that it has suitable properties with regard to heat resistance, in order to prevent a deformation of the material, in particular a deformation of the lowest container of the pile, which must, on the one hand, bear all the weight of the overlying containers, and on the other, resist—without deforming itself—to the noticeable amount of heat developed by the transported food.

The present invention has been described only for illustrative purposes with reference to a particular embodiment. However, it is obvious that the container could also have a non-circular shape, the channels 11 could extend along a not perfectly rectilinear (or not perfectly radial) path, and the holes 6 and 8 could have variable shapes and sizes.

The invention claimed is:

1. A container, or package, for a pizza and generally for warm food, comprising:

a cover (1);

a dish (2) that is connectable to the cover (1) by a joint, in order to close the container, using alignment and engagement means (3, 4);

a central portion formed from triangles (10, 10, . . . ) formed in the cover (1);

a plurality of vent windows (8, 8, . . . ) arranged in central first recesses (9) in the cover (1) for allowing steam to escape, said steam being developed by the warm food contained in the container;

a plurality of holes (6) provided only in second recesses (7) on an outer edge of the cover (1), the second recesses (7) being formed at a height that is more or less equal to that of the first recesses (9); and knurled regions (13) formed on a face of an inner side of the cover (1), the knurled regions (13) being adapted to prevent condensate beads from forming, the knurled regions (13) being formed on a great percentage of the face of the inner side of the cover not occupied by first and second holes, wherein said first recesses (9) communicate with a plurality of channels (11) that are formed on the cover and which extend radially up to an outer edge of the cover (1) in order to allow the steam to be dispersed in the atmosphere even when several containers are stacked on top of each other.

2. The container according to claim 1, wherein said holes (6) are provided in the recesses (7) communicating with said channels (11), the channels (11) extending up to the recesses (9) which are associated with the windows (8).

3. The container according to claim 2, wherein there are further provided transversal channels (12) that create a communication between said channels (11) which extend substantially radially up to the outer edge of the cover.

4. The container according to claim 1, which is formed of thermoplastic moulding material, or polystyrene of a grade used for foodstuffs.

5. The container according to claim 4, wherein said thermoplastic material is transparent.

6. The container according to claim 1, wherein an outer periphery of an area delimited by an assembly of the triangles (10) is provided in order to act as a reinforcement.

7. The container according to claim 1, said container having a circular form.

8. The container according to claim 1, wherein on an inner side of the dish (2) there are provided radial ribs (5).

9. The container according to claim 7, wherein ribs (5) form longitudinal cavities on an outer side of the dish (2).

10. A container according to claim 8, wherein several small, pin-shaped, cylindrical projections (14) are provided in proximity of the outer edge of the cover (1) and on an outer side of the cover (1), said small projections being spaced apart at angles corresponding to an angular separation existing between the ribs (5) of the dish (2).

11. A container, or package, for a pizza and generally for warm food, comprising:

a cover (1);

a dish (2) that is connectable to the cover (1) by a joint, in order to close the container, using an alignment and engagement mechanism (3, 4);

a central portion formed from triangles (10, 10, . . . ) formed in the cover (1);

a plurality of central circular vent windows (8, 8, . . . ) arranged in central first recesses (9) in the cover (1) for allowing steam to escape, which steam is developed by the warm food contained in the container;

a plurality of holes (6) provided only in second recesses (7) on an outer edge of the cover (1), the second recesses (7) being formed at a height that is more or less equal to that of the first recesses (9); and knurled regions (13) formed on a face of an inner side of the cover (1), the knurled regions (13) being adapted to prevent condensate beads from forming, the knurled regions (13) being formed on a great percentage of the face of the inner side of the cover not occupied by first and second holes, wherein said first recesses (9) communicate with a plurality of channels (11) that are formed on the cover and which extend radially up to an outer edge of the cover (1) in order to allow the steam to be dispersed in the atmosphere even when several containers are stacked on top of each other.

12. The container according to claim 11, wherein said holes (6) are provided in the recesses (7) communicating with said channels (11), the channels extending up to the recesses (9) which are associated with the windows (8).

13. The container according to claim 12, wherein there are further provided transversal channels (12) that create a communication between said channels (11) which extend substantially radially up to the outer edge of the cover.

14. The container according to claim 11, which is formed of thermoplastic moulding material, or polystyrene of a grade used for foodstuffs.

15. The container according to claim 14, wherein said thermoplastic material is transparent.

16. The container according to claim 11, wherein an outer periphery of an area delimited by an assembly of the triangles (10) is provided in order to act as a reinforcement.

17. The container according to claim 11, said container having a circular form.

18. The container according to claim 11, wherein on an inner side of the dish (2) there are provided radial ribs (5).

19. A container, or package, for a pizza and generally for warm food, comprising:

a cover (1);

a dish (2) that is connectable to the cover (1) by a joint, in order to close the container, using alignment and engagement means (3, 4);

a central portion formed from triangles (10, 10, . . . ) formed in the cover (1);

a plurality of central circular vent windows (8, 8, . . . ) arranged in central first recesses (9) in the cover (1) for allowing steam to escape, which steam is developed by the warm food contained in the container;

a plurality of triangular holes (6) provided in second recesses (7) only on an outer edge of the cover (1), the second recesses (7) being formed at a height that is more or less equal to that of the first recesses (9); and knurled regions (13) formed on a face of an inner side of the cover (1), the knurled regions (13) being adapted to prevent condensate beads from forming, the knurled regions (13) being formed on a great percentage of the face of the inner side of the cover not occupied by first and second holes, wherein first recesses (9) communicate with a plurality of channels (11) that are formed on the cover and which extend radially up to an outer edge of the cover (1) in order to allow the steam to be dispersed in the atmosphere even when several containers are stacked on top of each other.

* * * * *